United States Patent [19]

McCoy

[11] Patent Number: 4,690,026

[45] Date of Patent: Sep. 1, 1987

[54] PITCH AND AMPLITUDE CALCULATOR AND CONVERTER WHICH PROVIDES AN OUTPUT SIGNAL WITH A NORMALIZED FREQUENCY

[75] Inventor: Bing McCoy, #8 Carderock Ct., Bethesda, Md. 20817

[73] Assignees: Bing McCoy, Bethesda, Md.; Donald DeLaski, Great Falls, Va.

[21] Appl. No.: 768,447

[22] Filed: Aug. 22, 1985

[51] Int. Cl.[4] ..... G10H 1/12; G10H 3/02; G10H 7/00

[52] U.S. Cl. ..... 84/1.19; 84/1.28; 84/DIG. 9

[58] Field of Search ..... 84/1.01, 1.19–1.21, 84/1.28, DIG. 9

[56] References Cited

U.S. PATENT DOCUMENTS 3,647,929 3/1972 Milde, Jr. ..... 84/1.01

3,960,043 6/1976 Brand ..... 84/1.19

4,151,775 5/1979 Merriman ..... 84/1.01

4,463,650 8/1984 Rupert ..... 84/1.19

*Primary Examiner*—Stanley J. Witkowski

*Attorney, Agent, or Firm*—Cushman, Darby & Cushman

[57] ABSTRACT

A system for converting musical sounds into digital data for use with a electronic synthesizer. An infra red pitch sensor detects pitch of string vibration. Envelope of this signal is filtered and applied to a comparator with floating threshold. Square wave output of comparator is used to reset a continually running counter and latch valid data into a latch. Valid data is used as address for a memory which contains quantized values corresponding to standard musical notes. Transposition of keys may be accomplished in memory lookup table. Amplitude of input signal is detected by A/D converter, and with pitch information from memory lookup table is sent to processor. Processor makes decision when valid data is present, and when present outputs data to synthesizer.

25 Claims, 6 Drawing Figures

PITCH AND AMPLITUDE CALCULATOR AND CONVERTER WHICH PROVIDES AN OUTPUT SIGNAL WITH A NORMALIZED FREQUENCY

BACKGROUND OF THE INVENTION

1. Field of the Disclosure

This invention relates in general to music systems. More specifically, this invention provides an arrangement to be used in connection with a musical instrument to create electrical signals in response to an input musical sound. These signals can be analog or digital and are adapted to be used with an electronic music synthesizer.

2. Description of the Prior Art

Electronic music synthesizers create varied musical sounds by generating various shaped wave forms at a desired pitch and amplitude. In general a synthesizer system will contain controls for varying the spectral content, harmonic content, amplitude, envelope shape, attack and delay time and other parameters that affect the timbre of musical. sounds as perceived by the human ear. The operator of an electronic synthesizer thus has two major functions that must be performed. He must "shape" the wave, thus determining its timbre and character, and he must input the note or notes that the shaped wave form should assume.

There are two basic ways to input this note information. One is to use a standard piano keyboard as the input device. The problem with this method is that the output signal cannot be dynamically controlled in response to the input signal. Specifically, the volume of the output signal will not depend on the force with which the key is depressed, and must be separately controlled. This utilization of a piano-type keyboard also limits the synthesizer operation to those who have the ability to play a keyboard instrument.

A more versatile method of providing "note" input is to use the musical signal from *any* musical instrument to control the synthesizer's sounds. Many advantages are obtained from this technique. For one, a much larger class of people could operate an electronic synthesizer, as any musical instrument with which one is familiar could be used as the input source. Another advantage is that the output volume of the note from the synthesizer can be made to depend on the volume of the input note from the instrument.

Any musical instrument that is able to generate musical vibrations can be used as an input source to an electronic synthesizer, providing an appropriate interface is used. Different synthesizers accept different input signals such as: linear DC control voltages proportional to the pitch of the desired note, sine waves representing the pitch to be output, or digital data to a microprocessor controlled music synthesizer. Since a musical sound typically includes a number of harmonics or overtones of varying amplitude, a problem has existed in that a synthesizer could falsely detect more than one frequency present in a single note. In response to this, a number of devices called pitch detectors or frequency followers have been proposed. The operation of a typical pitch detector will be described herein.

There are four basic methods of entering the musical signal into the pitch detector. One is by playing the instrument in proximity to an electromagnetic microphone. Mechanical transducers and electromagnetic pickups attached to the instrument itself can also be used, although this method is most often employed in conjunction with a stringed instrument. A fiber optic entry system can also be used. One form of fiber optic entry system, which is used exclusively with string instruments, detects the motion of the string and converts that motion to electrical signals. Another fiber optic system, as described in U.S. Pat. No. 4,442,750 to Bowley uses light modulation within optical fibers to generate a fiber optic signal which is later amplified.

Once an electrical signal corresponding to the musical sound has been entered into the pitch detector, a number of different methods can be used to extract the necessary information from the signal. U.S. Pat. No. 4,351,216 to Hamm discloses one form of electronic pitch detection system. In the Hamm pitch detector, a reference point in each cycle of the input signal is determined by setting a threshold level for the signal. This reference point is generated whenever the signal crosses this threshold level. An estimate of the period of the signal is obtained from the duration between successive reference points. In this system, a special algorithm must be used to determine a proper threshold level for each signal envelope.

U.S. Pat. No. 4,300,431 to de Rocco also teaches a pitch detector for an electronic musical instrument. This pitch detector generates a control voltage corresponding to the frequency of the input music signal, the purpose of this control voltage being to control an electronic music synthesizer. This system uses a closed loop in which a certain number of contiguous pitch values must be obtained before the pitch input is considered as detected. De Rocco deals with the problem of harmonics by using a low pass filter with a variable passband attempting to filter out the harmonics of the complex musical signal. The pulse train from the output of this filter runs a counter which generates a number proportional to the period of the pulse train. Using a shift register and a voltage controlled oscillator, an error voltage is obtained which is proportional to the frequency of the input signal and this error voltage is used to control the electronic synthesizer. A variation of this method of pitch detection is also used in U.S. Pat. No. 4,193,332 to Richardson. The disclosures of Hamm, de Rocco, and Richardson are expressly incorporated herein by reference.

U.S. Pat. No. 4,313,361 to Deutsch teaches a digital frequency follower which calculates using comparisons between internal test signals and the musical input signal to generate an indication of the pitch.

The present invention has as its objectives a new and improved method and apparatus for calculating the pitch and amplitude of an input complex musical signal. New functions can be performed with this system, and many of the problems existing in the prior art are overcome by the novel methods of this invention.

One major problem which still exists in the prior art is that of the long response time when a low note is entered into a pitch detector. This problem occurs because of the long period of the low note, and the necessity for a successive number of identical values to be sensed before a sufficient confidence level is obtained that the note being sensed is more than just spurious noise. Thus, with a low note, there is an appreciable delay time between the entry of the note and the control signal output in the prior art. This can make synchronization, which is necessary for a musical piece, difficult and disconcerting to the user. This problem is overcome by this invention as described with reference to the preferred embodiment.

Another problem in the prior art was that the necessity for the instrument to be in perfect tune. The pitch detector would sense the period of the note, and output a control signal corresponding to this period without any adjustments. This invention uses a method of quantizing each musical note to a predetermined period corresponding to a standard musical note before output of a control signal. In this way, the musical instrument used as the input device can be out of tune, but the output note will be perfectly quantized to a set musical reference note.

Other problems in the prior art are specific to interface devices used between stringed instruments and music synthesizers, such as the apparatus in the preferred embodiment. A number of such problems in the infra red pickup systems used on a stringed instrument are discussed in my co-pending application, Ser. No. 768,446 filed Aug. 22, 1985. An Optical Pickup For Use With A Stringed Musical Instrument, the disclosure of which is expressly incorporated herein by reference.

Another problem in the prior art results from the physics of string motion. When a string is initially struck, the initial vibration is eccentric and unstable. Since one advantage of the current invention is rapid calculation of the pitch value, a special feature of this invention allows it to detect the pitch of the string during this initial unstable period.

One known method of pitch detection relies on low pass filtering of the musical note to remove higher order harmonics from the musical signal. A problem in the prior art is that the musical range of a single string can be two octaves or more, and this cannot be efficiently accommodated with a single low pass filter. A special circuit in this invention consisting of two low pass filters which function in a special way overcomes this limitation.

Another problem in the prior art is that of the pitch detector obtaining an erroneous pitch value immediately after obtaining a valid one. One reason for this is that when a string is released by a player, there is a brief period during which a pitch one-half step lower than the note is sounded. The microprocessor in the present invention detects such a spurious pitch and eliminates the incorrect number value being generated. Another incorrect pitch value can be obtained when an octave harmonic appears to the pitch detector. The controlling program of this system will not output an octave value unless the string or note is retriggered, thus also eliminating octave errors.

The present invention relates to a microprocessor controlled pitch and amplitude calculator and converter for use with any source of musical sound input. By use of a number of novel methods and designs, this system overcomes many of the limitations of the prior art as listed above.

SUMMARY OF THE INVENTION

The present invention consists of a universal pitch calculator and converter for converting notes produced a musical instrument to electrical signals in the proper format for use with an electronic music synthesizer. The invention consists of a microprocessor controlled system which has as its output a series of digital numbers representing the pitch and gain data of the input musical note or notes.

A special infra-red pickup optimized for use in a pitch detector system such as described in my co-pending application, Ser. No. 768,446, is attached to a stringed instrument. The output from this pickup is routed to a stand alone unit where it is first amplified. This amplified signal is routed to a full wave rectifier and to an averaging circuit. The average analog value undergoes an A to D conversion, and the digital number representing the average analog value is treated as an input by the microprocessor. The average value is also used to detect a new note occurance.

This previously amplified signal is also applied to a low pass filter pair where undesired harmonic frequencies in the musical note are excised. The filtered signal is then routed to a comparator which produces a square wave output proportional to the pitch of the filtered signal. A special signal then converts the frequency of this square wave output to a digital number. This digital number is used as an address for a memory means. This memory means contains at every possible address, a quantized value representing a fundamental frequency of a standard note pitch as data corresponding to that address. This quantized data word is then output from this memory to the microprocessor.

Operationally, the microprocessor is given average analog value data by the A to D converter, and digitized and quantized pitch data from the pitch calculator circuit. The microprocessor then decides when valid data exists and outputs digital information to the electronic music synthesizer only then. Among other criterion, the microprocessor must receive a pulse from the new note detector indicating that a new note has been issued by the musical instrument. The microprocessor must also detect an identical pitch a predetermined consecutive number of times before it will consider that pitch to be valid.

The term quantize is used throughout this specification to refer to a normalized signal which represents a standard signal to which all non-standard signals are normalized. For instance, a number of frequencies can occur within a predetermined range, and all still indicate a same note. The term "quantize" indicates that this range is normalized to a frequency which is taken as the standard frequency indicative of notes within this range.

A further advantage of the system exists in that by changing the programming of the memory means, an automatic calculation of pitch transposition can be accomplished by this invention.

BRIEF DESCRIPTION OF THE DRAWINGS

An exemplary and presently preferred embodiment of the invention will be described in detail with reference to the accompanying drawings, wherein.

DETAILED DESCRIPTION OF THE PREFERRED EMBODIMENT

Figure 1:
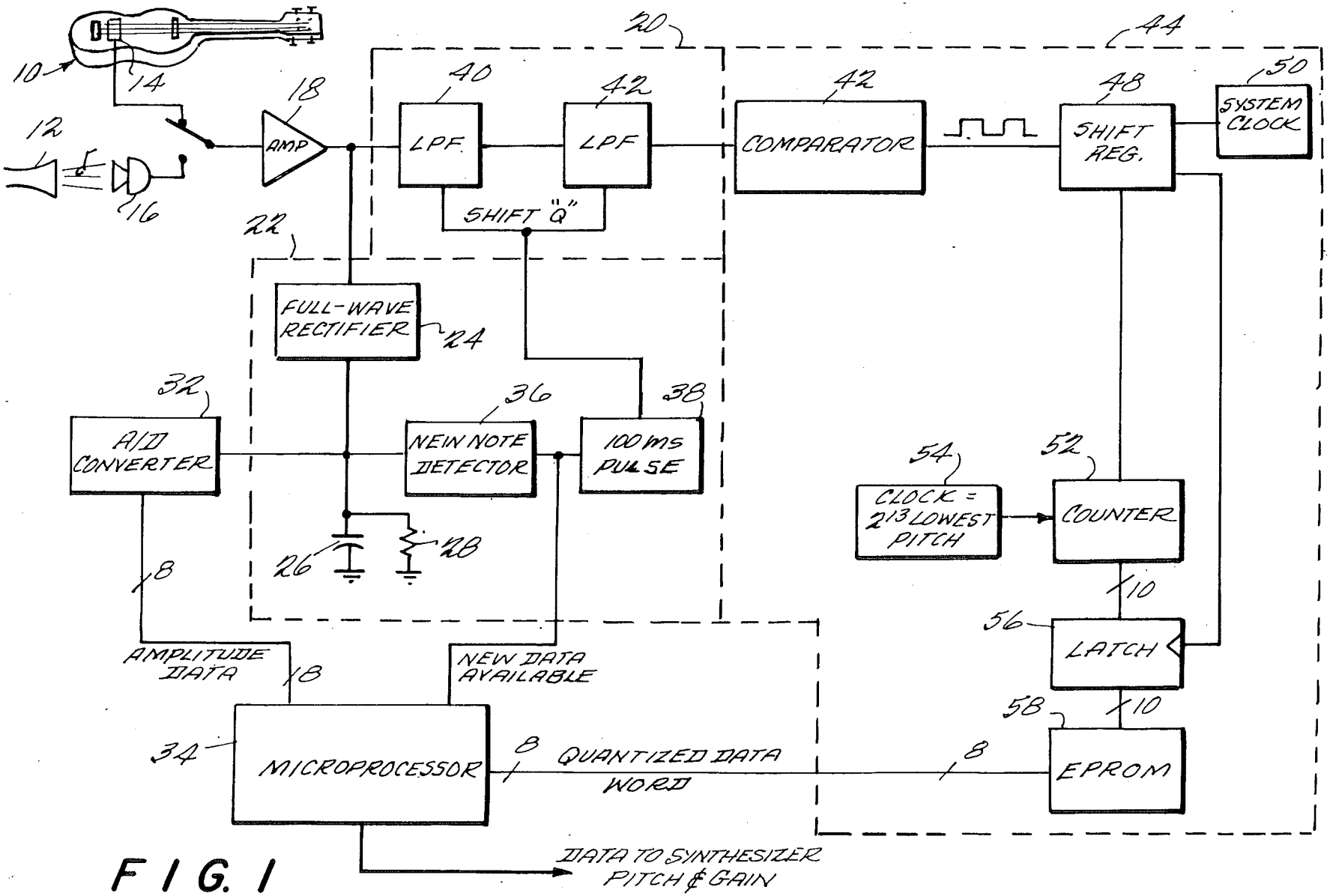
FIG. 1 is a block diagram of the preferred embodiment.

Reference is now made to FIG. 1 which shows a specific embodiment of the present invention in block diagram form. The general operation of the system will be discussed with reference to FIG. 1.

Referring to FIG. 1, musical instrument 10 or 12 is used to input the musical sound to the apparatus. In the case of stringed instrument 10, the signal entry means can be a specialized optical pitch detector as described in my co-pending application, Ser. No. 768,446 and as generally shown in FIGS. 2 and 3.

Figure 3:
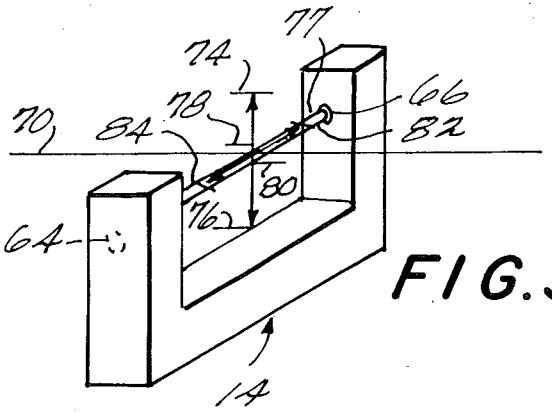
FIG. 3 is a diagram of string motion in the plane of this infra red pitch sensor.
Figure 2:
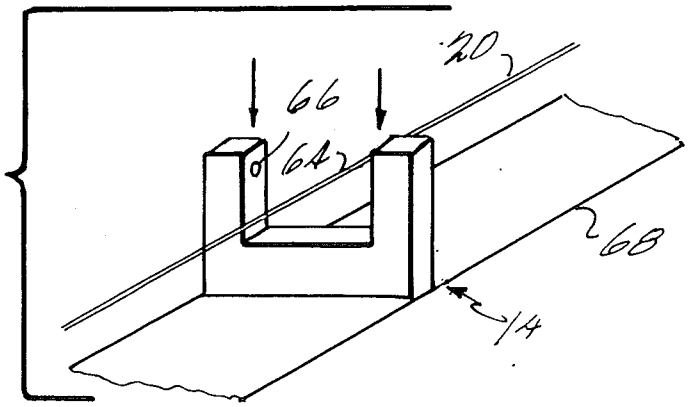
FIG. 2 is an optical pitch sensor, in this case an infra red version.

The detector as shown in FIGS. 2 and 3 includes infra red transmitters and receivers 64 and 66. The pickup device itself is located on substrate 68 so that string 20 will extend therethrough.

As generally described in my co-pending application Ser. No. 768,446, the motion of string 70 is shown in FIG. 3. As string 70 vibrates, the vibration consists of up and down motion and side to side motion. The limits of the up and down motion are represented by location 74 and 76. Thus, the string passes across the infrared field 77 shown by locations 78 and 80 during each cycle of its vibration. The back and forth motion, however, does not pass out of infrared field 77 as shown in locations 82 and 84. Back and forth motions within the limits of 82 and 84 can also be caused by the musician bending the string. A specialized pitch detector such as this is necessary because the pitch calculator cannot process polyphonically-that is there can be only one musical note as input to any given pitch calculator circuit. The prior art magnetic and optical pickups, in general would pick up at least some of the vibration of adjacent strings, which would be unacceptable with a system such as in the preferred embodiment. In the case of wind instrument 12, an ordinary microphone 16 can be used to transduce the sound into electrical signals (as only a single note at a time can be produced by a wind instrument).

The desired signal is routed to an amplifier 18 where the low level signal produced by the signal entry means 14 or 16 is amplified to a higher voltage. The output of amplifier 18 is routed to a low pass filter circuit 20, and to an averaging circuit 22.

Averaging circuit 22 consists of a full wave rectifier 24 followed by a capacitor 26. Capacitor 26 has a discharge path to ground through resistor 28. The amplified signal is rectified and passed to capacitor 26 which charges to the average analog voltage value of the musical note. In this way, a voltage corresponding to the average value of the musical input signal is continually available at node 30. This average value is sampled by analog to digital conversion means, in the case A/D converter 32, which produces an eight bit word corresponding to the gain value of the input signal. This eight bit word is fed to a processing means 34 (in this case a 6809 microprocessor).

The average voltage available at node 30 is also fed to new note detector means 36. This device uses a floating threshold to track the analog value of the signal, and produces a pulse when any sudden shift in the analog value is detected. The pulse produced by new note detector 36 is fed both to processor 34 to indicate that new data is available, and to pulse means 38 which produces a 100 millisecond pulse for use with low pass filter system 20 in a way described herein.

The periodic signal produced by musical instrument signal 10 or 12 and amplified by 18 is also fed to low pass filter system 20. Low pass filter system 20 consists of two low pass filters (LPFs). LPF 40 has its cutoff frequency set at the root value of the particular string, where root value is the pitch of the string when completely open (not pressed to fretboard). LPF 42 is set two octaves above the root value and is in series with LPF 40. Both filters 40 and 42 are switched capacitor type filters which allow stable operation at high rolloff or "Q" and allow the filter cutoff frequency to be switched easily by switching the clock rate of the switching capacitor. In addition, both filters 40 and 42 have a variable "Q" which can be electronically switched as described below.

In a stringed instrument, the vibrating string generates the most harmonic data at the root pitch. First LPF 40 is set at this root value, which effectively reduces harmonic errors at the root. A player can, however, obtain a much higher pitch from the string by sufficiently shortening its effective length. As the string becomes higher pitched, the filter output gain of LPF 40 becomes less and less until it becomes unusable. Second LPF 42 is tuned two octaves above LPF 40 and stays essentially inactive until the pitch of the string approaches two octaves above the root. When the pitch from this string approaches two octaves above the root, (LPF 42 begins to resonate and boost the gain sufficiently for further processing. A detailed discussion of these filters 40 and 42 in operation follows with reference to FIG. 5.

When a string is first struck, the initial vibration is eccentric and unstable. The physics of string vibration are such that the string initially vibrates at the root pitch and degenerates into harmonics. This problem is solved using new note detector 36. When the string is first struck (or a note is first sounded) new note detector 36 outputs a pulse. This pulse is then routed to pulsing circuit 38 and the resultant pulse output to the shift "Q" input of low pass filters 40 and 42. During the duration of this 100 millisecond pulse, the "Q" value is lowered to about 6 DB per octave. This allows pitch calculation during this critical period of initial string instability. At the end of the 100 millisecond pulse, LPFs 40 and 42 are set back to high "Q" for continued tracking of the pitch.

The output of low pass filter system 20 is then applied to the pitch calculator/quantizer circuitry 44. In this circuit, the filtered signal is first connected to a comparator which utilizes a "floating" reference voltage. The floating threshold for this comparator is provided by a resistor and capacitor which give an average analog voltage threshold for the incoming signal. The filtered signal is compared with this threshold, with the output of the comparator changing states whenever this threshold is passed by the filtered signal. A square wave output corresponding to the frequency of the filtered input signal is thus produced. This comparator circuit also has a preset hysteresis network to reduce oscillation in the comparator switching region.

The square wave signal obtained from comparator 46 is routed to shift register 48 where it is synchronized with system clock 50. A counter 52 is driven by a clock 54 which oscillates at a rate of $2^{13}$ times the lowest possible pitch applied to the system. Counter 52, which is a 14 bit counter, will count how many cycles of clock 54 it receives before it is reset. The reset to counter 52 occurs when 4-bit shift register 48 has a high level of the square wave from comparator 46 on its "D" input and a rising edge occurs on system clock 50. In this way counter 52 is reset in synchronization with the system clock.

Shift register 48 also clocks 10 bit latch 56 to preserve the currently valid data on the 10 lines between counter 52 and latch 56. The clock signal to latch 56 from shift register 48 occurs a sufficient time before counter 52 is reset so that no race conditions occur in the setup of data into latch 56.

The 10 bit number appearing at the output of latch 56 is used as an address for a memory means, in this case EPROM 58. This allows controlled quantizing of the incoming data. Subtle variations in pitch, in addition to strings which are not completely in tune, cause varying pitch values. EPROM 58 contains a table which allows a range of incoming values to be assigned a specific number value. For example, a note "A 440" may be varying between the values of "A 446" and "A 435". EPROM 58 will output the same number for the two values. In this way, processor 34 receives only the quantized table value for the note being input. Processor 34 is flagged every time a pitch period is calculated.

Processor 34 compares a preset number of samples, and if they are identical a valid pitch value is generated. Software requires that processor 34 receive *identical* values consecutively for a valid pitch determination. If one number is out of range, processor 34 invalidates the data and attempts to recalculate subsequent samples.

Using the technique of pitch calculating and quantizing as described with reference to calculating circuit 44, a serious problem in the prior art is overcome. In the prior art, as in the embodiment described above, a processing means would require a preset number of identical values consecutively before it would allow a pitch value to be generated. This increased the confidence level that the pitch value calculated was not just spurious noise or string harmonics. Because lower musical notes have a longer period of vibration, an appreciable delay is generated in calculating a pitch value, especially in systems requiring many samples before output of the pitch value. The information in this case would lag the input note causing annoyance to the musician and difficulty of synchronization.

To compensate for this, an alternative embodiment of this system allows the user to switch the electronics to allow a stringed instrument to use all high pitched strings. For example, a guitar uses a $E^{(1)}/B/G/D/A/E^{(2)}$ string configuration with the low $E^{(2)}$ string being two octaves below the high $E^{(1)}$ string. In this alternative embodiment the user may put on all high $E^{(1)}$ strings and tune them all to high E. By adjusting EPROM 58 in pitch calculator circuit 44 for B/G/D/A, and $E^{(2)}$ strings, the software and hardware will compensate for this change and reproduce what would be the correct value for the string had it been played with the correct tuning. This allows a rapid calculation of pitch values for all strings, while allowing the musician to play his instrument normally. Because the music synthesizer reproduces the correct pitch, the player does not hear the incorrect (or unadjusted) value of the string.

Another routine in the system reduces harmonic errors and half step errors in the system calculation. This routine compares the value of valid samples and tests for numbers that would represent an octave harmonic above the valid sample. This routine will not allow an octave value to be output unless the new note detector is retriggered. Similarly, when the string is playing a half step below the valid sample, this incorrect number is ignored by the processor 34 unless a new note has been detected. The physics of string motion are such that when a string is released by a player, there is a brief period that a pitch one half step lower is sounded. This routine eliminates these errors and could not easily work without the incoming data having been quantized so as to facilitate calculation by processor 34 of octave harmonics and half steps.

An optical pitch sensor system for use on a stringed instrument and in conjunction with this system is shown in FIG. 2. Many infra red reproducer pickups are taught by the prior art. Typically, these reproducer pickups are mounted such that the infrared field is created in a plane perpendicular to the fret board with either emitter below the string and detector above the string or vice versa. In these pickups, the infra red field produced by the emitter is disturbed by the string as it vibrates. This is detected by the detector and converted to electrical signals. A form of infra red sensor optimized for use with this invention is shown in FIG. 2. This optical pitch detector 66 parallel to the plane of the fret board of the instrument 68. This parallel mounting allows consistent tracking of the string in any position across the finger or fret board, and if the string is bent by the musician to alter the pitch it is not bent out of the infra red field.

Pitch sensor 14 is not a good reproducer of the string vibration, as it clips any motion of the string outside of the infra red field. In this embodiment, the infra red field is very narrow, with a 1 mm aperture. It does track accurately the pitch of the string because the vibrating string breaks the infra red field as it oscillates.

Figure 4:
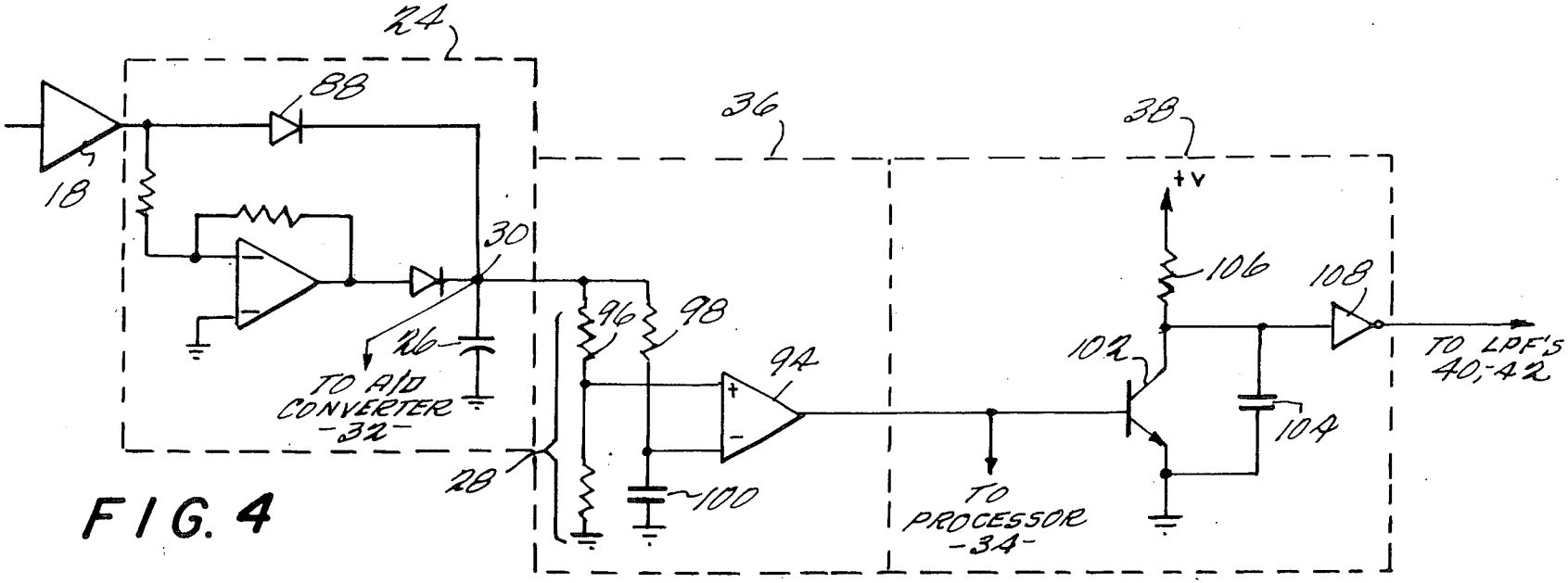
FIG. 4 is a detailed diagram of the new note detector means as shown in FIG. 1.

After the musical signal is brought into the universal pitch converter, the first step in the converter is to amplify this signal as done by amplifier 18. This amplified signal is then passed to low pass filter system 20 and new note detector system 22. Referring to FIG. 4, a detailed diagram of new note detector system 22 is shown. Musical sound as amplified by amplifier 18 is initially rectified by full wave rectifier 24. Rectifier 24 consist of diode 88 in parallel with an inverting amplifier 90 having unity gain. Inverting amplifier 90 is embodied here as an operational amplifier circuit, but many other embodiments are possible. The output from inverting amplifier 90 is fed to diode 92. The outputs from diodes 88 and diodes 92 are summed at node 30, diode 88 having rectified the positive parts of the signal while amplifier 90 and diode 92 have inverted and rectified the negative parts of the signal. Also connected to node 30 is capacitor 26 for averaging the full wave rectified signal to a DC level. Capacitor 26 has a discharge path to ground across resistors 28 so that the DC voltage on capacitor 26 will track approximately the RMS value of the input musical signal. This average value at node 30 is also applied to A/D converter 32 to provide amplitude data in digital form to processor 34.

This DC level at node 30 is also applied to new note detector means 36. The voltage is connected to one pole of an op amp 94 through the resistive divider consisting of resistors 96 and 97. The voltage is connected to the other pole of op amp 94 through resistor 98 with capacitor 100 to ground thus forming an RC charging network on the second pole of op amp 94. Op amp 94 is configured as a comparator in this embodiment.

In operation, a new note is detected by detector 36 because capacitor 26 gets briefly charged to a higher value than capacitor 100 when a new analog level is set. This is due to capacitor 26 being charged directly by full wave rectifier 24 while capacitor 100 has series resistance 98 to limit its charging rate. When capacitor 26 has a higher voltage than capacitor 100, comparator 94 toggles to a "1" level. Capacitor 100 soon charges to the same value however, and comparator 94 toggles back to "0". This pulse detects the initial impact of a note or string. Capacitors 26 and 100 allow a "floating threshold" as they track the general analog value of the signal, however, any sudden shifts such as a note being struck or sounded causes the circuit to imbalance and generate a pulse.

The pulse generated is sent both to processor 34 to indicate that new data is available, and to pulsing means 38. Pulsing means 38 can be a monostable multivibrator integrated circuit such as the 74 123 type made by Texas Instruments, or an SN 555 as made by Texas Instruments. In this embodiment the multivibrator is made from a transistor 102 which causes a short circuit across capacitor 104 when turned on. When transistor 102 is off, capacitor 104 must charge through resistor 106 to its full value. Capacitor 106 is followed by Schmidt trigger 108 which provides hysteresis and insures a clean pulse edge. This pulse is routed to the shift Q inputs of low pass filters 40 and 42.

The detailed operation of low pass filter system 20 will be discussed with reference to FIG. 5. Low pass filter system 20 takes advantage of the characteristics of real low pass filters not behaving ideally. By putting two filters in series, tuned in the special way defined by this invention, a low pass filter system is produced that attains the objectives desired by this system.

Figure 5:
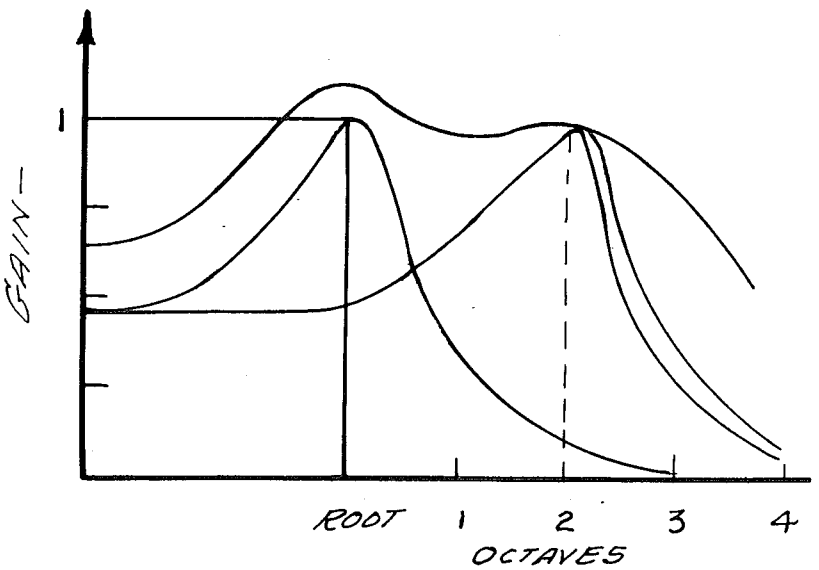
FIG. 5 is a more detailed drawing of the low pass filtering system as shown in FIG. 1.

Referring to FIG. 5, curve 110 shows a gain/frequency curve of an ideal filter with its cutoff frequency at the root value of the string. Curve 112 shows the actual gain/frequency curve for low pass filter 40, tuned to the root value of the string. In this non-ideal filter, frequencies much below the cutoff value are passed by the filter without much amplification. As the cutoff value of the filter is approached, the filter begins to "resonate", and the filter's gain increases significantly.

The gain of the filter as shown in curve 112 is highest in the region of the cutoff value. At a frequency two octaves above this cutoff value, the gain of low pass filter 40 has become so low that the output would be unusable. At this point, low pass filter 42, which is tuned two octaves above the root value, has begun to resonate thereby boosting the gain back up. The output of the combination of filters 40 and 42 together is shown as the resultant curve 116 in FIG. 5. As these curves show, by using the peculiar characteristics of a real low pass filter, a gain/frequency characteristic is obtained for the system which performs the desired functions.

Curves 112 and 114 correspond to the rolloff characteristics of low pass filters 40 and 42 when in the high "Q" state. As previously explained, during certain times it is desirable to lower the Q value so as to obtain a more gradual slope. This has the effect of allowing a pitch to be detected from a more unstable note, such as exists when a string is first plucked.

Figure 6:
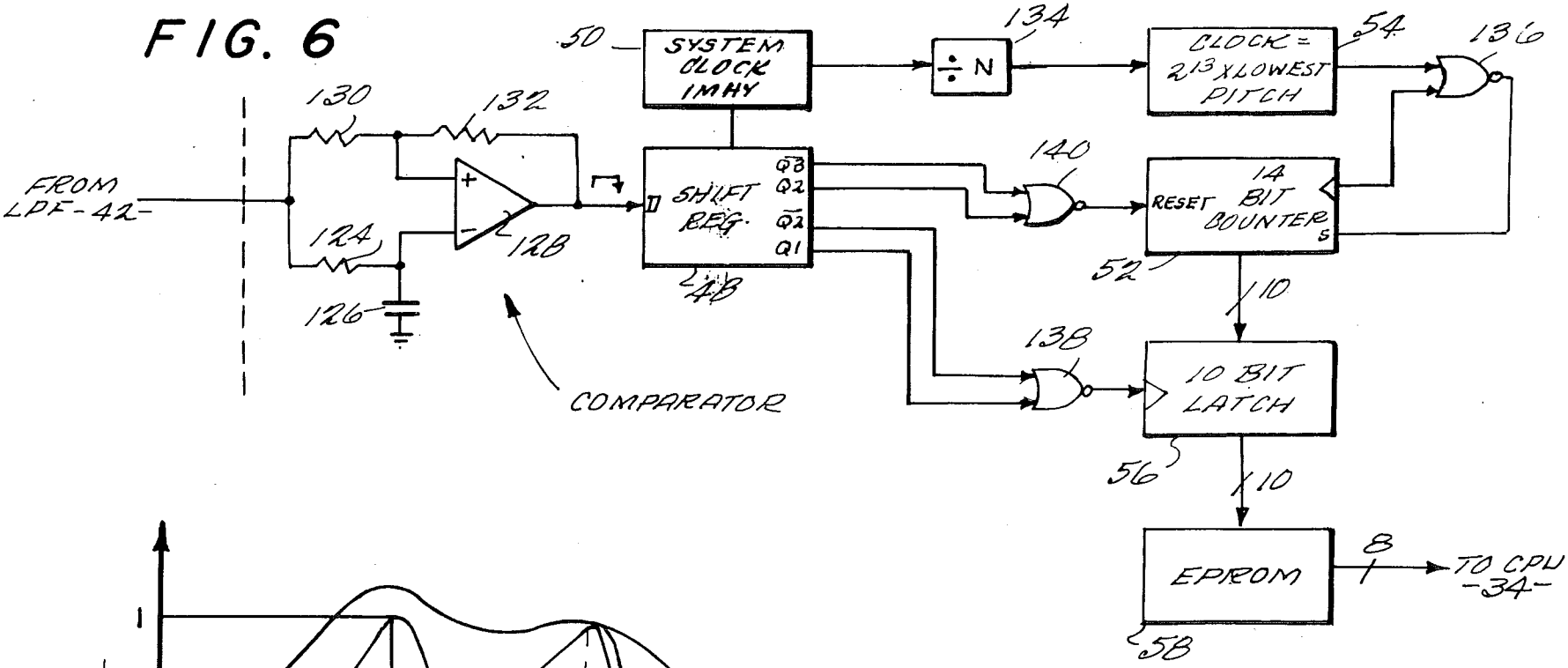
FIG. 6 is a detailed diagram of the quantizing means as shown in FIG. 1.

The output of low pass filter system 20 is connected to pitch calculator/quantizer 44, a detailed drawing of which is shown in FIG. 6.

In operation, the filtered signal is initially input to comparator 46. Comparator 46 uses a floating threshold, continually adjusted to the average value of the signal. This averaging is done by resistor 124 and capacitor 126 which is connected to one pole of op amp 128. The other pole of op amp 128 goes directly to the signal through resistor 130. Feedback and hysteresis is accomplished by a resistor 132 between one pole of op amp 128 and its output. Resistor 124 and capacitor 126 give an average analog voltage for the incoming signal. The incoming signal is compared against this average voltage, and the output of op amp 128 changes state each time the input signal crosses the threshold set by this average voltage. This produces a square wave with the same frequency as the input signal at the output of comparator 128.

The output from comparator system 46 is then connected to shift register 48. Shift register 48 uses the one MHz system clock 50 as its timing source, and acts to synchronize the edges of the square wave from comparator 128 with system a second clock 50. System clock 50 is also used to produce clock 54 which operates at $2^{13}$ times the lowest possible pitch of the string. A divide by "N" device 134 is used to produce clock 54 from clock 50.

Clock 54 is used to operate 14 bit counter 52 which counts the frequency of the square wave as output from comparator system 46. The digital count from this counter is routed to the 10 bit latch 56.

In operation, clock 54 continually increments counter 52. The square wave produced by comparator system 46 is used as input to the "D" input of shift register 48. At each rising edge of system clock 50, the state change of the input signal begins being shifted down the register chain. On any falling edge of the input signal, the first system clock pulse will cause the data currently on 14 bit counter 52 to be latched into 10 bit latch 56. The second system clock pulse will reset counter 52, thus beginning the cycle over again. From this time that counter 52 is reset, it begins at zero, counting clock pulses from clock 54. If the input signal is of the lowest possible pitch is input, the frequency of clock 54 has been chosen such that $2^{13}$ clock pulses will be counted before counter 52 is again reset, and thus 14 bit counter 52 will not be overflowed. If the period of the signal is shorter than this lowest pitch signal, the digital number stored in latch 56 will be a count of the number of clock pulses between occurances of counter 52 being reset. Counter 52 also has an overflow preventing mechanism, whereby if the number $2^{13}$ is ever exceeded, a high level emanates from the S14 output and "jams" NOR gate 136. In this way, no further clock pulses are allowed to increment 14 bit counter 52, and it stays in this state until reset.

Shift register 48 works as follows: on a falling edge of the input square wave signal, the $Q_1$ output of shift register 48 initially goes low. This signal has not yet propagated down to the second register, so $\overline{Q}_2$ will also be low for this one clock pulse. $Q_1$ and $\overline{Q}_2$ are input to nor gate 138. When both $Q_1$ and $\overline{Q}_2$ are low, a high pulse to clock latch 56 is caused thus preserving the current count on counter 52. Similarly, on the next clock pulse, $Q_2$ and $\overline{Q}_3$ cause nor gate 140 to toggle to a high and reset 14 bit counter 52.

Latch 56 receiving a rising edge from nor gate 138 indicates that there is valid data on its input lines, and this data is clocked into latch 56 at this time. The valid data, which corresponds to a digital count of the frequency of the input pulse, then appears at the output of latch 56. This output is used as an address to EPROM 58.

The quantizing of the pitch of the musical signal is accomplished by EPROM 58 in the following way: EPROM 58 contains a "lookup table" wherein all possible pitch values of the particular string are contained as addresses in EPROM 58. Corresponding to every address within EPROM 58 is abnormalized value corresponding to the standard musical note closest to the detected input address. Thus, if counter 52 output contains a number that would correspond to the note "A 435", that number would be used as address for EPROM 58. The data in EPROM 58 at address "A 435" would be "A 440", the normalized value for "A435". This 8-bit number would be output to processor 34. In this way, EPROM 58 quantizes an entire range of musical values to a standardized note.

An alternative embodiment of this system allows the user to alter the electronics of the pitch calculator to enable him to use a string instrument tuned with all high strings. The advantage of this embodiment is that since all notes are high frequencies, detection of the pitch is accomplished much faster. The quantizing technique as described above enables the implementation of this alternate embodiment. Since the data in EPROM 58 need not have any correspondence to the address, detecting the pitch for a high "F", for example, could cause the EPROM to output pitch data corresponding to a low C. By simply changing EPROM 58 in pitch calculator circuit 44, the lookup table can be adjusted to output different pitch values from those entered, while still quantizing entered pitch values to the nearest transposition note.

An eight bit word representing amplitude data from A to D converter 32 and an eight bit word representing the quantized pitch value from EPROM 58 is routed to processor 34 which provides digital data for use with an electronic music synthesizer. Processor 34 uses its internal program to calculate whether a valid pitch has been recognized and when valid amplitude data exists. Processor 34 receives a new data available pulse from new note detector 22, and will not allow half step or octave changes without a new note being detected as described above. Processor 34 also performs certain housekeeping functions in addition to formatting the data and amplitude for use with the electronic synthesizer.

Although only a few exemplary embodiments of this invention have been described in detail above, those skilled in the art will readily appreciate that many modifications are possible in the exemplary embodiments without materially departing from the novel teachings and advantages of this invention.

Accordingly all such modifications are intended to be included within the scope of this invention as defined in the following claims.

What is claimed is:

1. A system for determining a standard quantized fundamental frequency of a periodic signal from a musical instrument, comprising:

means for detecting said periodic signal and providing a detect signal indicative thereof;

threshold means for determining when said detect signal exceeds a predetermined threshold;

counter means for counting the number of times said threshold is exceeded in a determinable time period and providing a count indicative thereof;

memory means for storing a plurality of quantized fundamental frequencies at predetermined addressable locations, said quantized frequencies representing a standard frequency to which all frequencies within a predetermined range are normalized; and means for addressing said memory means based on said count and reading the quantized fundamental frequency stored thereat.

2. A system as in claim 1 wherein said quantized fundamental frequency corresponds to a quantized value of the pitch input from said musical instrument.

3. A system as in claim 1 wherein said quantized fundamental frequency corresponds to a quantized value of a pitch differing from the pitch input from said musical instrument by a transposition factor.

4. A system as in claim 1 wherein said predetermined threshold is a value corresponding to the average level of said periodic signal.

5. A system for determining a standard fundamental frequency of a periodic signal from a musical instrument, comprising:

detector means for detecting said periodic signal and providing an electrical signal indicative thereof;

comparator means for determining when said periodic signal passes a predetermined threshold value;

counter means for counting the number of times said periodic signal passes said threshold in a determinable time period and providing a count indicative thereof;

memory means for storing a plurality of standard fundamental frequencies at addresses corresponding to all possible values of said count; and means for addressing said memory means using said count as the address for said memory means, said standard fundamental frequency being contained as data corresponding to said address.

6. A system as in claim 5 wherein said standard is a value which represents a standard pitch that differs from said pitch of said musical note by a transposition factor.

7. A system as in claim 5 wherein said predetermined threshold value is the analog average of said periodic signal.

8. A system as in claim 6 further comprising:

processing means for determining if a predetermined consecutive number of said standard fundamental frequencies are identical, and not allowing output of valid data until said predetermined number of standard fundamental frequencies are detected.

9. A pitch and amplitude conversion system for a musical instrument converting musical signals into digital data for use with an electronic music synthesizer, comprising:

signal entry means for producing an electrical signal corresponding to the pitch and amplitude of said musical instrument;

filtering means for reducing the harmonic content of said electrical signal;

threshold means for determining when a predetermined analog threshold value is passed by said electrical signal;

counter means for counting the number of times said predetermined threshold is passed by said electrical signal in a determinable time period and providing a count indicative thereof;

memory means for storing a plurality of fundamental frequencies at predetermined address locations;

means for addressing said memory means using said count as the address, and data corresponding to said address is a quantized standard representing the pitch of a standard musical note; and processing means for selectively accepting as valid or rejecting as invalid said quantized standard.

10. A system as in claim 9 further comprising:

new note detector means for detecting when a new note has been produced by said musical instrument.

11. A system as in claim 10 further comprising:

means for varying the rolloff slope of said filtering means in response to said detection of said new note.

12. A system as in claim 11 further comprising:

means for providing the average analog value of said electrical signal to said processing means.

13. A system as in claim 12, wherein said pitch of said quantized standard differs from said input musical signal by a transposition factor.

14. A system as in claim 12 wherein said counter means comprises:

first clock means for providing a system clock;

comparator means for determining when said filtered electrical signal passes said predetermined threshold;

shift register means for synchronizing the output from said comparator means with said system clock;

second clock means for providing a clock at a frequency of $2^{13}$ times the lowest possible input frequency to the system;

resettable counter means for counting the number of clock pulses from said second clock means;

latch means for preserving the count on said resettable counter means at such time in the cycle as said data is determined to be valid;

wherein said count is latched into said latch means upon a state change of said synchronized comparator means output, and subsequently said shift register resets said resettable counter means.

15. A system as in claim 10 wherein said processing means accepts as valid a pitch value only after receiving three identical pitch values consecutively.

16. A system as in claim 15 wherein further said processing means rejects any note a half step lower than the previous note unless said new note detector means indicates that a new note has been produced.

17. A system as in claim 16 wherein further said processing means rejects any note one octave higher than the previous note unless said new note detector means detects a new note having been produced.

18. A device as in claim 17 wherein said signal entry means is an infra red pitch sensor system.

19. A method for determining a quantized fundamental frequency of the periodic signal from a musical instrument, comprising the steps of:

converting said periodic signal to an electrical signal indicative thereof;

generating a digital number corresponding to the number of times said periodic signal passes a predetermined threshold in a predetermined time period;

storing data in a memory, said data including a plurality of quantized standards representing a value to which all data within a range is normalized at predetermined addressable locations of said memory;

addressing said memory based on said digital number; and reading the quantized standard stored at the addressed location.

20. A method as in claim 19 wherein said quantized standard differs from said frequency of said periodic signal by a transposition factor.

21. A method as in claim 19 further comprising the steps of:

determining if a preset consecutive number of said quantized values are identical; and outputting valid data when said preset consecutive number of identical values are detected.

22. A method for pitch and amplitude conversion for a musical instrument converting musical signals into digital data comprising the steps of:

producing an electrical signal corresponding to the pitch and amplitude of said musical instrument;

reducing the harmonic content of said electrical signal by filtering;

generating a digital number corresponding to the number of times said electrical signal passes a predetermined threshold in a predetermined time period;

storing in a memory a plurality of values which are indicative of standard note pitch values at predetermined addresses;

providing said digital number as an address to said memory, thereby receiving as data a quantized standard therefrom;

selectively accepting or rejecting said quantized standard and providing an output signal for any of said accepted quantized standards.

23. A method as in claim 22 further comprising the step of detecting when a new note has been produced by said musical instrument.

24. A method as in claim 22 further comprising the step of altering the gain/frequency response characteristics of the means used for said reducing step when said detecting step detects a new note.

25. A method as in claim 24 further comprising the step of generating a digital number corresponding to the average amplitude of said musical signal.

* * * * *